US005730233A

United States Patent [19]

Beaudin

[11] Patent Number: 5,730,233

[45] Date of Patent: Mar. 24, 1998

[54] METHOD FOR DETECTING CHANGES IN RATE OF DISCHARGE OF FLUID FROM A WELLBORE

[75] Inventor: Laurent Beaudin, Edmonton, Canada

[73] Assignee: Alberta Industrial Technologies Ltd., Edmonton, Canada

[21] Appl. No.: 683,965

[22] Filed: Jul. 22, 1996

[51] Int. Cl.[6] ..... E21B 47/04

[52] U.S. Cl. ..... 175/48; 175/206

[58] Field of Search ..... 175/48, 40, 66, 175/206, 207

[56] References Cited

U.S. PATENT DOCUMENTS

| | | | |
|---|---|---|---|
| Re. 35,114 | 12/1995 | Ingman | 73/269 |
| 3,498,393 | 3/1970 | West et al. | 175/48 |
| 3,726,136 | 4/1973 | McKean et al. | 73/155 |
| 3,824,855 | 7/1974 | Heckle | 73/194 B |
| 4,000,645 | 1/1977 | Dower | 73/155 |
| 4,440,239 | 4/1984 | Evans | 175/5 |
| 4,527,959 | 7/1985 | Whiteman | 417/342 |
| 4,616,700 | 10/1986 | Wood et al. | 166/250 |
| 4,683,944 | 8/1987 | Curlett | 166/65.1 |
| 4,809,791 | 3/1989 | Hayatdavoudi | 175/40 |
| 5,070,949 | 12/1991 | Gavignet | 175/48 |
| 5,423,205 | 6/1995 | Farchone | 73/32 R |

FOREIGN PATENT DOCUMENTS

| | | | |
|---|---|---|---|
| 654 262 | 3/1979 | U.S.S.R. | B01D 3/42 |
| 950 905 | 8/1982 | U.S.S.R. | E21B 44/00 |
| 1 476 113 | 4/1989 | U.S.S.R. | E21B 44/00 |
| 2 024 895 | 1/1980 | United Kingdom | E21B 21/08 |

*Primary Examiner*—Frank Tsay
*Attorney, Agent, or Firm*—Anthony R. Lambert

[57] ABSTRACT

A method for detecting changes in the rate of discharge of fluid from a well bore. Firstly, providing a flow nipple having a first end, a second end, and a flow line connection extending substantially radially from the flow nipple intermediate the first end and the second end. Secondly, providing a drilling fluid treatment tank. Thirdly, providing a flow line having a first end and a second end. The first end is connected to the flow line connection of the flow nipple and the second end to the drilling fluid treatment tank. This creates a flow path for drilling fluids from the flow nipple along the flow line to the drilling fluid treatment tank. Fourthly, providing an elongate antechamber adjoining one of the flow nipple, the flow line or the drilling fluid treatment tank. The elongate antechamber has a first end and a second end. The first end is positioned in fluid communication with the flow path. The second end extends above the flow path, such that the second end of the elongate antechamber is free of drilling fluid unless a sudden increase in flow rate results in an influx of drilling fluid into the elongate antechamber. Fifthly, positioning a fluid sensing probe in the elongate antechamber. The fluid sensing probe is spaced from and extends toward the first end of the elongate antechamber, such that the fluid sensing probe provides a reading of the level of drilling fluid in the elongate antechamber.

1 Claim, 3 Drawing Sheets

METHOD FOR DETECTING CHANGES IN RATE OF DISCHARGE OF FLUID FROM A WELLBORE

FIELD OF THE INVENTION

The present invention relates to a method for detecting changes in the rate of discharge of fluid from a wellbore; with particular application to shallow rig drilling operations.

BACKGROUND OF THE INVENTION

When drilling for oil, drilling fluid is pumped from mud tanks by surface pumps down into the well through a tubular drill string. The drilling fluid then passes back up the well bore along an annular passage formed between an outside of the tubular drill string and the sidewalls of the well bore, referred to as the "annulus". When the drilling fluid reaches the surface, it is diverted through a flow nipple positioned on top of a blowout preventer into a flow line which, after some treatment, returns the drilling fluid to the mud tanks for recirculation.

During drilling operations, the rate of fluid return is monitored. A increase in the rate of return of fluid could be indicative of an increase in flow due to gas, oil or formation water entering the well bore. Early detection of an increase in the rate of return allows the rig operator or driller to secure the well before the influx of fluid causes excessive pressure to build.

A common method of detection is to place a flow sensing device in the flow line leading from the flow nipple. The flow sensing device, usually in the form of a paddle sensor, is positioned midway in the flow line. This method and associated apparatus tends to work well as long as the flow line is oriented with a downward slope. In shallow rig drilling operations, however, there is less clearance and, as a consequence, the flow line is horizontal. When the flow line is horizontal, it fills with fluid. In this environment the paddle sensor no longer provides advance warning of a change in flow rate.

SUMMARY OF THE INVENTION

What is required is a method for detecting changes in the rate of discharge of fluid from a wellbore that is better suited for shallow rig drilling.

According to the present invention there is provided a method for detecting changes in the rate of discharge of fluid from a wellbore. Firstly, providing a flow nipple having a first end, a second end, and a flow line connection extending substantially radially from the flow nipple intermediate the first end and the second end. Secondly, providing a drilling fluid treatment tank, whereby drilling fluid is treated prior to being returned to mud tanks from which it originated for recirculation. Thirdly, providing a flow line having a first end and a second end. The first end is connected to the flow line connection of the flow nipple. The second end is connected to the drilling fluid treatment tank. This creates a flow path for drilling fluids from the flow nipple along the flow line to the drilling fluid treatment tank. Fourthly, providing an elongate antechamber adjoining one of the flow nipple, the flow line or the drilling fluid treatment tank. The elongate antechamber has a first end and a second end. The first end is positioned in fluid communication with the flow path. The second end extends above the flow path, such that the second end of the elongate antechamber is free of drilling fluid unless a sudden increase in flow rate results in an influx of drilling fluid into the elongate antechamber. Fifthly, positioning a fluid sensing probe in the elongate antechamber. The fluid sensing probe is spaced from and extends toward the first end of the elongate antechamber, such that the fluid sensing probe provides a reading of the level of drilling fluid in the elongate antechamber.

With the method, as described above, an increase in fluid flow along the fluid path enters the antechamber where it encounters the probe. By monitoring the readings provided by the probe the rig operator or driller is provided with warning of an increase in flow rate. The probe can be connected to a visual or auditory alarm to draw the rig operator or drillers attention to such increase in flow rate.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
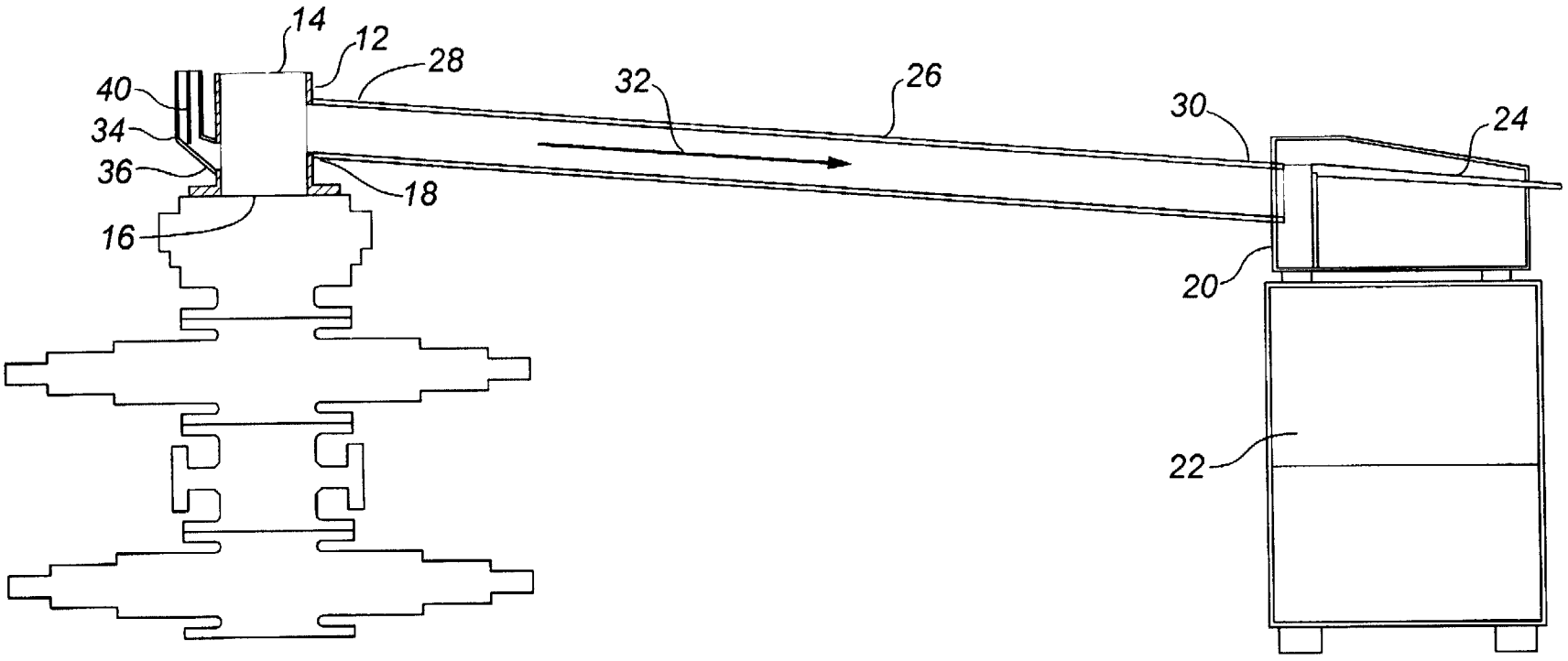
FIG. 1 is a side elevation view of a first mud recirculation system constructed in accordance with the teachings of the present method.
Figure 2:
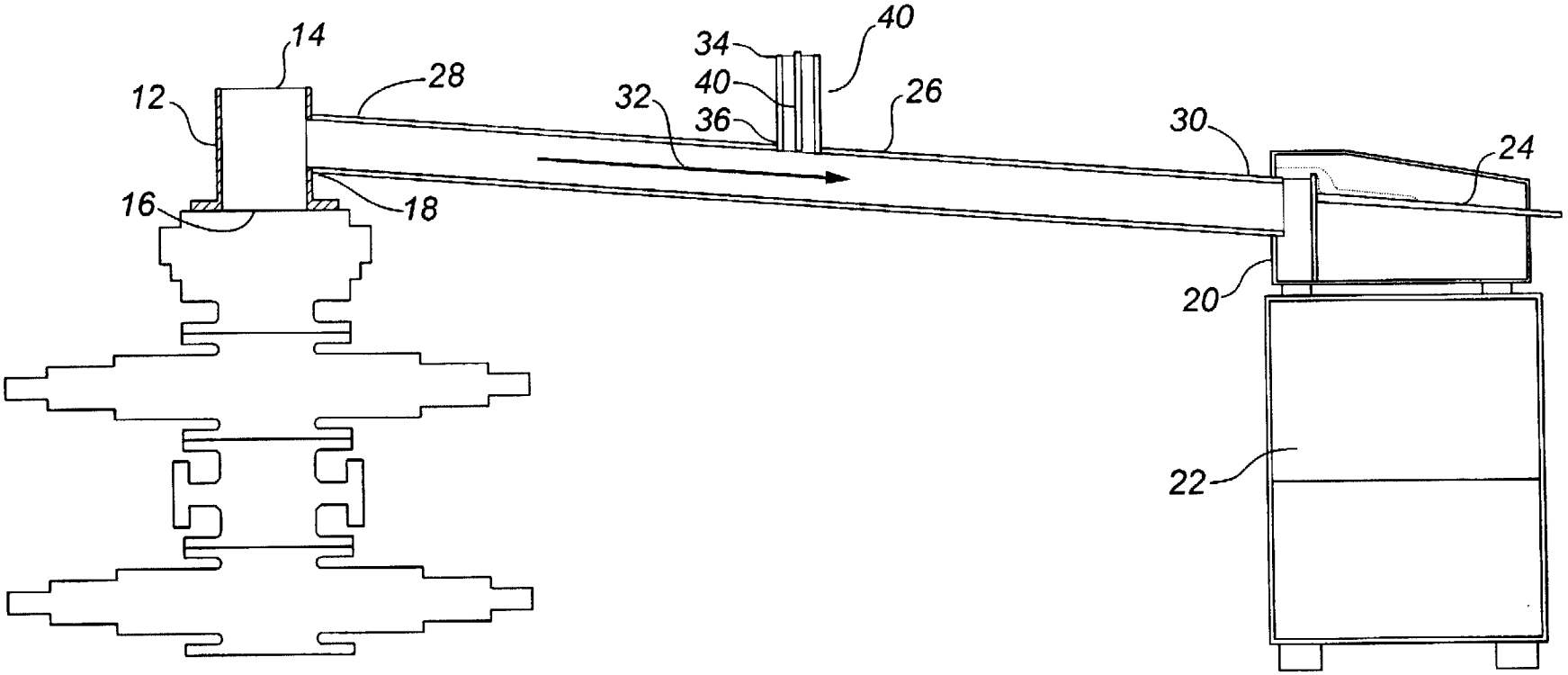
FIG. 2 is a side elevation view of a second mud recirculation system constructed in accordance with the teachings of the present method.
Figure 3:
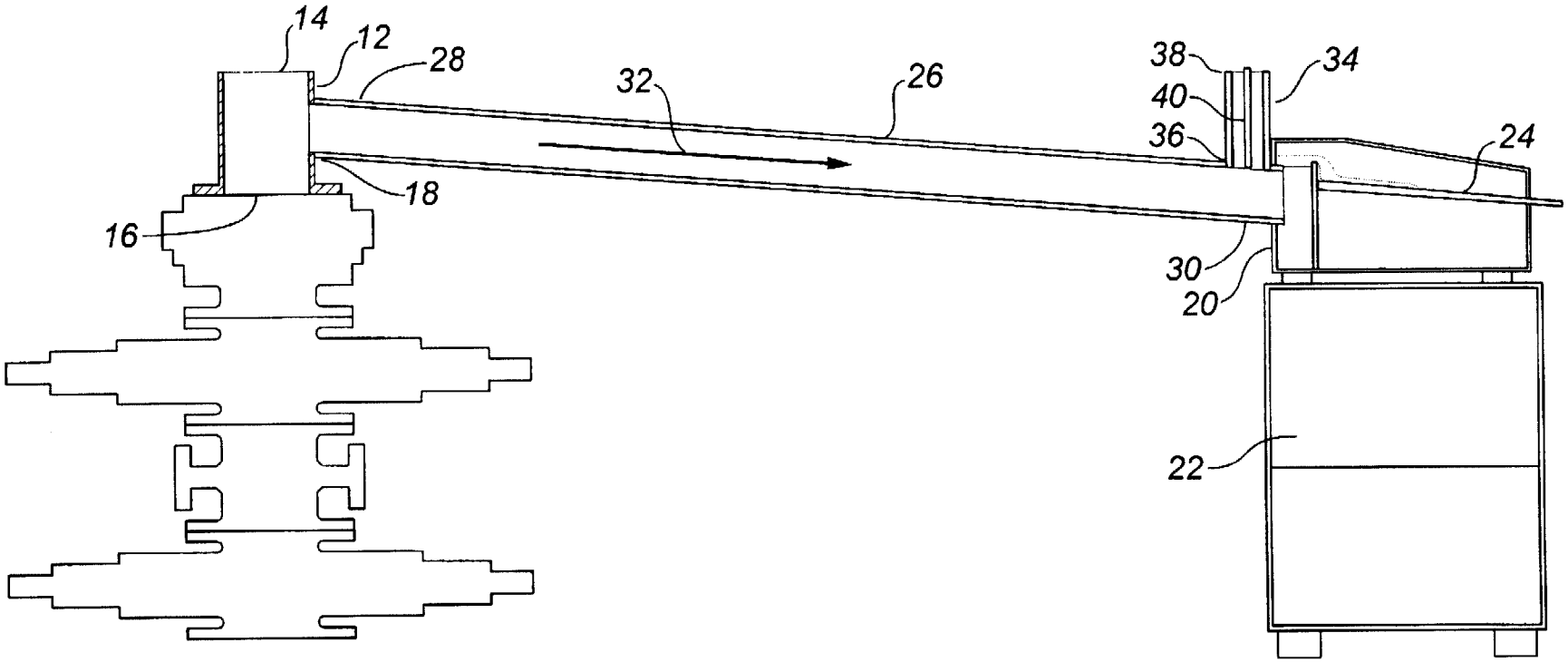
FIG. 3 is a side elevation view of a third mud recirculation system constructed in accordance with the teachings of the present method.

The preferred method for detecting changes in the rate of discharge of fluid from a wellbore will now be described with reference to FIGS. 1 through 3.

Firstly, providing a flow nipple 12 having a first end 14, a second end 16, and a flow line connection 18 extending substantially radially from flow nipple 12 intermediate first end 14 and second end 16. Secondly, providing a drilling fluid treatment tank 20, whereby drilling fluid is treated prior to being returned to mud tanks 22. In the illustrated embodiments, drilling fluid entering drilling fluid treatment tank 20 passes through a shaker 24. Thirdly, providing a flow line 26 having a first end 28 and a second end 30. First end 28 is connected to flow line connection 18 of flow nipple 12. Second end 30 is connected to drilling fluid treatment tank 20. This creates a flow path for drilling fluids, generally indicated by arrows 32, from flow nipple 12 along flow line 26 to drilling fluid treatment tank 20. Fourthly, providing an elongate antechamber 34 along flow path 32. As is demonstrated in FIGS. 1, 2, and 3, elongate antechamber 34 can be placed at various locations along flow path 32. In FIG. 1, elongate antechamber 34 is shown adjoining flow nipple 12. In FIG. 2, elongate antechamber 34 is shown adjoining flow line 26. In FIG. 3, elongate antechamber 34 is shown adjoining drilling fluid treatment tank 20. Elongate antechamber 34 has a first end 36 and a second end 38. First end 36 is positioned in fluid communication with flow path 32. Second end 38 extends above flow path 32. Fifthly, positioning a fluid sensing probe 40 in elongate antechamber 34. Fluid sensing probe 40 is spaced from and extends toward first end 36 of elongate antechamber 34.

As drilling fluid circulates along flow path 32, second end 38 of elongate antechamber 34 is above the flow and, as such, is free of drilling fluid. However, should there be a sudden increase in flow rate, an influx of drilling fluid enters into elongate antechamber 34 and rises from first end 36 of elongate antechamber 34 toward second end 38. Fluid sensing probe 40 provides a reading of the level of drilling fluid in elongate antechamber 34. The readings provided by fluid sensing probe 40 is connected to instruments monitored by the rig operator or driller. A change is fluid levels within elongate antechamber 34, as indicated by fluid sensing probe 40, provides a warning of an increase in flow rate. Fluid sensing probe 40 can also be connected to a visual or auditory alarm to draw the rig operator or drillers attention to such increase in flow rate.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A method for detecting changes in the rate of discharge of fluid from a wellbore, comprising the steps of:

firstly, providing a flow nipple having a first end, a second end, and a flow line connection extending substantially radially from the flow nipple intermediate the first end and the second end;

secondly, providing a drilling fluid treatment tank whereby drilling fluid is treated prior to return to mud tanks;

thirdly, providing a flow line having a first end and a second end, the first end being connected to the flow line connection of the flow nipple, the second end being connected to the drilling fluid treatment tank, thereby creating a flow path for drilling fluids from the flow nipple along the flow line to the drilling fluid treatment tank;

fourthly, providing an elongate antechamber adjoining one of the flow nipple, the flow line or the drilling fluid treatment tank, the elongate antechamber having a first end and a second end, the first end being positioned in fluid communication with the flow path, the second end extending above the flow path, such that the second end of the elongate antechamber is free of drilling fluid unless a sudden increase in flow rate results in an influx of drilling fluid into the elongate antechamber; and fifthly, positioning a fluid sensing probe in the elongate antechamber, the fluid sensing probe being spaced from and extending toward the first end of the elongate antechamber, such that the fluid sensing probe provides a reading of the level of drilling fluid in the elongate antechamber.

* * * * *